US011450298B2

(12) United States Patent
Cocca

(10) Patent No.: US 11,450,298 B2
(45) Date of Patent: Sep. 20, 2022

(54) DRUM PEDAL, RETROFITTING ASSEMBLY FOR A DRUM PEDAL, AND METHOD OF RETROFITTING A DRUM PEDAL

(71) Applicant: Donato Cocca, Brussels (BE)

(72) Inventor: Donato Cocca, Brussels (BE)

( * ) Notice: Subject to any disclaimer, the term of this patent is extended or adjusted under 35 U.S.C. 154(b) by 0 days.

(21) Appl. No.: 17/422,783

(22) PCT Filed: Jan. 31, 2020

(86) PCT No.: PCT/EP2020/052505

§ 371 (c)(1),
(2) Date: Jul. 14, 2021

(87) PCT Pub. No.: WO2020/157318

PCT Pub. Date: Aug. 6, 2020

(65) Prior Publication Data

US 2022/0084488 A1 Mar. 17, 2022

(30) Foreign Application Priority Data

Jan. 31, 2019 (BE) ..... 2019/5058

(51) Int. Cl.
*G10D 13/11* (2020.01)

(52) U.S. Cl.
CPC ..... *G10D 13/11* (2020.02)

(58) Field of Classification Search
CPC ..... G10D 13/11
See application file for complete search history.

(56) References Cited

U.S. PATENT DOCUMENTS

| | | | | |
|---|---|---|---|---|
| 5,388,494 | A * | 2/1995 | Hoshino | G10D 13/11 84/422.1 |
| 5,994,635 | A | 11/1999 | Hoshino | |
| 6,278,046 | B1 | 8/2001 | Sikra et al. | |
| 6,590,147 | B2 | 7/2003 | Kassabian | |
| 6,762,354 | B2 | 7/2004 | Cocca | |
| 7,671,262 | B1 * | 3/2010 | Lin | G10D 13/11 84/422.1 |
| 8,269,089 | B2 * | 9/2012 | Sato | G10D 13/11 84/422.1 |
| 10,529,306 | B2 * | 1/2020 | Shigenaga | G10D 13/11 |
| 11,037,536 | B2 * | 6/2021 | Sikra | G10D 13/11 |
| 2008/0053292 | A1 | 3/2008 | Fournier et al. | |
| 2022/0084488 | A1 * | 3/2022 | Cocca | G10D 13/11 |

OTHER PUBLICATIONS

ISR and Written Opinion for PCT/EP2020/052505 dated May 4, 2020 (11 pages).

* cited by examiner

*Primary Examiner* — Robert W Horn
(74) *Attorney, Agent, or Firm* — Hamre, Schumann, Mueller & Larson, P.C.

(57) ABSTRACT

Drum pedal for striking a drum, the pedal comprising:
- a support having at least one leg;
- a rotary shaft borne by said support;
- a beater mounted on said rotary shaft and configured to rotate upon rotation of said rotary shaft, wherein the beater is configured to strike the drum;
- an actuation mechanism for rotating the beater in a first direction towards the drum;
- a return mechanism for rotating the beater in a second direction opposite the first direction away from the drum.

15 Claims, 4 Drawing Sheets

Figure 1:
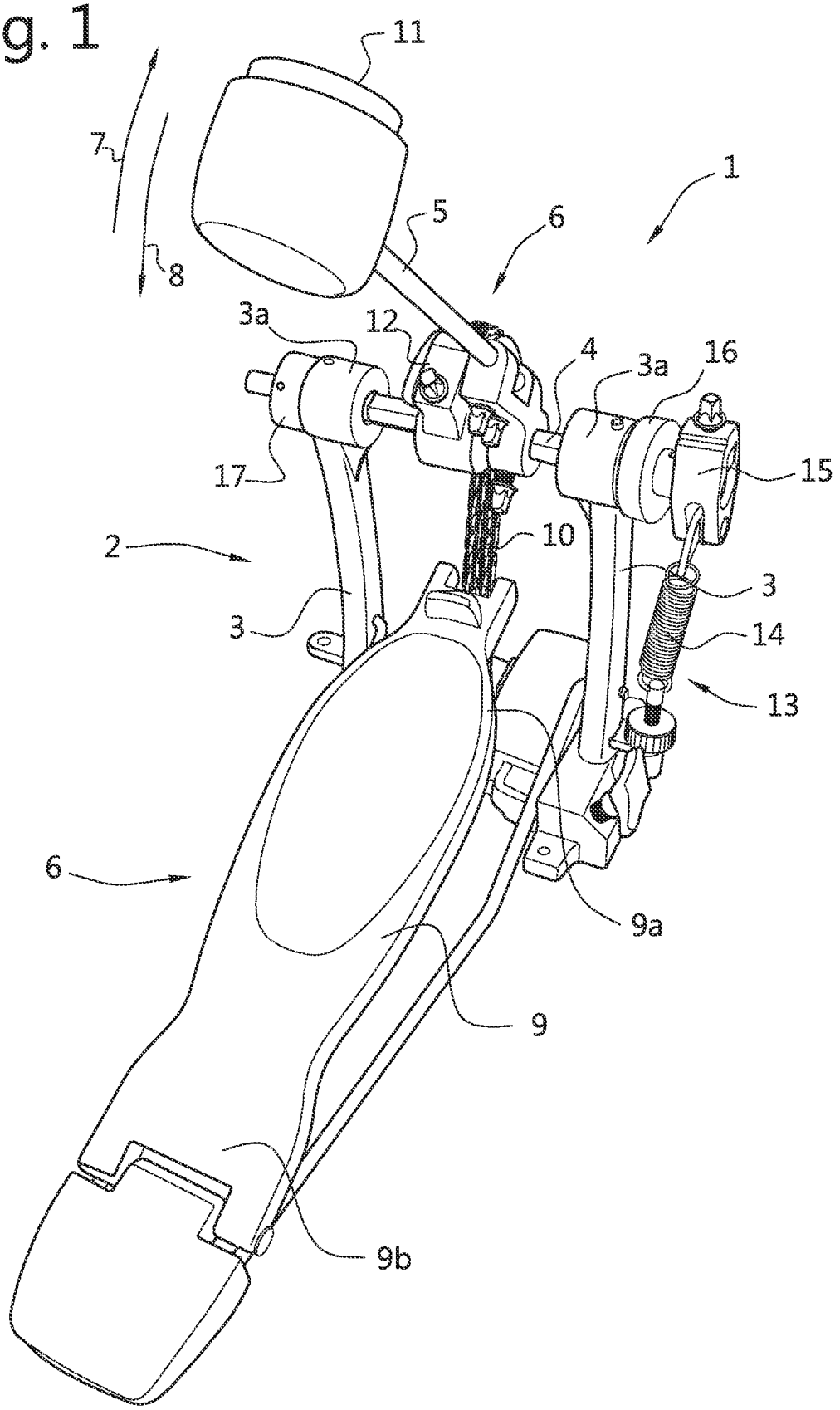

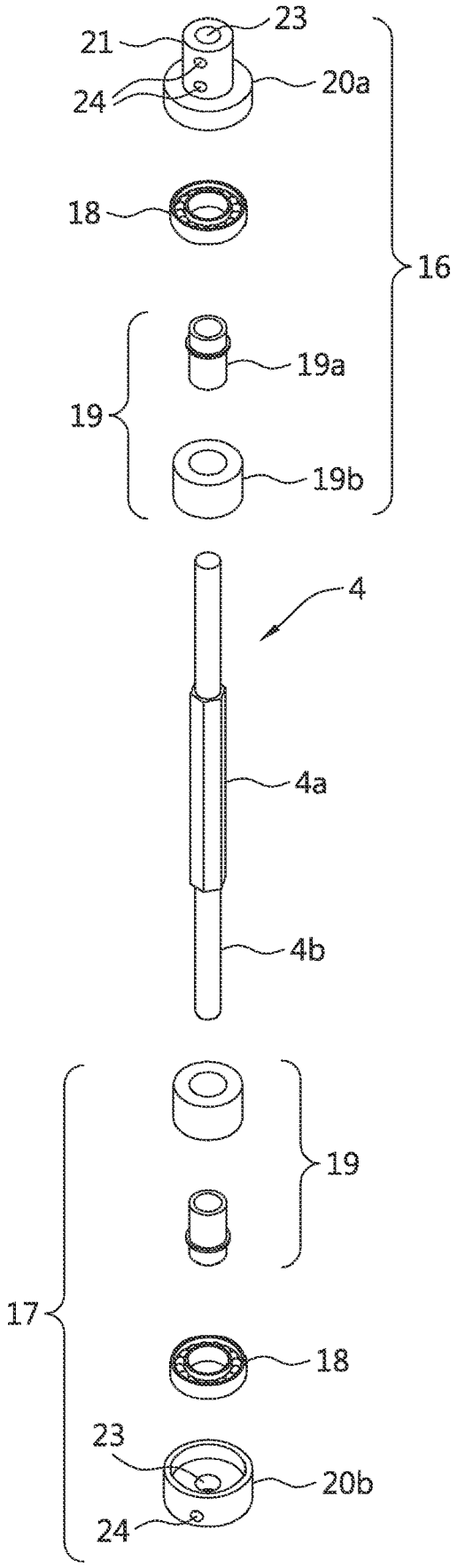
Fig. 2a
Fig. 2b
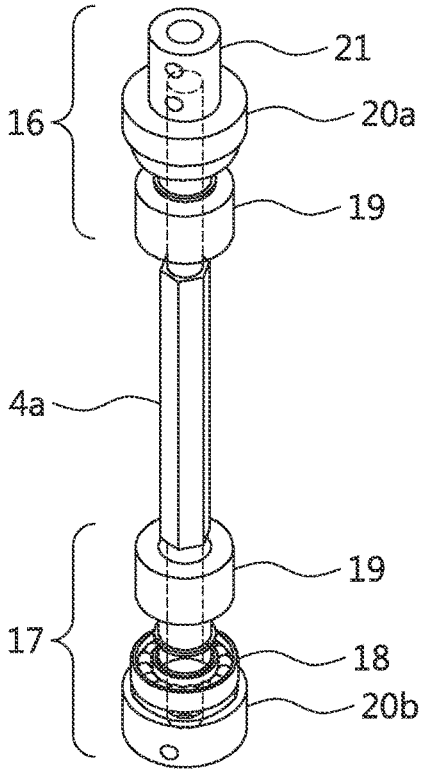

DRUM PEDAL, RETROFITTING ASSEMBLY FOR A DRUM PEDAL, AND METHOD OF RETROFITTING A DRUM PEDAL

The invention relates to a drum pedal for striking a drum, in particular a bass drum, with a beater by a movement of the pedal.

Such a device is generally known from prior art. The pedal generally includes a support having one or two legs. The support is configured to bear a rotatable shaft extending through an upper end of the one or two legs of the support. A beater is mounted on the shaft in such a way that the beater can make a rotating movement around the shaft towards and away from a drum to be struck by the beater. The drum pedal further includes an actuation mechanism to move the beater towards the drum, and a return mechanism for moving the beater away from the drum. The actuation mechanism generally includes a foot plate such that a pushing movement on the foot plate is transferred via for example a chain into a rotating movement of the shaft such that the beater moves towards the drum. When pressure on the foot plate is released, the return mechanism, which may for example be embodied as a spring, is configured to move the beater away from the drum. In case of a support with two legs, these legs are spaced apart and are placed on either lateral side of the foot plate.

These generally known drum pedals present several problems and disadvantages. In order to be able to strike the drum with force or power, it may be advantageous to have a relatively heavy and solid drum pedal. At the same time, the heavier the drum pedal, the more the return mechanism needs to be tensioned, the higher the risk the user is going to suffer from tendinitis, which in severe cases may force the user to abandon playing the drums. Moreover, a relatively heavy drum pedal may impede a relatively precise and rapid movement of the beater. Additionally, in attempts to alleviate these disadvantages, drum pedals have become increasingly complicated, the pedals including for example many different pieces, which can make the pedals relatively vulnerable to adjustment issues between the different pieces, subject to relatively small manufacturing tolerances and can increase manufacturing costs.

It is an aim of the present invention to solve or alleviate one or more of the above-mentioned problems. Particularly, the invention aims at providing an improved drum pedal which allows a relatively precise attack on the drum, without losing power, while keeping the number of pieces of the drum pedal and the overall weight of the pedal relatively low.

To this aim, according to a first aspect of the present invention, there is provided a drum pedal characterized by the features of claim 1. In particular, the drum pedal for striking a drum comprises a support having at least one leg. The support can for example have the shape of a letter L in case of a single upstanding leg, or may have the shape of a letter U in case of two upstanding legs. The drum pedal also comprises a rotary shaft borne by said support, in particular borne by an upper end of the at least one upstanding leg of the support. The rotary shaft extends substantially transversely to the upstanding leg in the same plane as the plane of the support, i.e. substantially in parallel to a bottom part of an L or U shaped support. Other shapes of support may be possible as well. The rotary shaft is configured to rotate about a central longitudinal axis of the shaft itself. The drum pedal further comprises a beater mounted on said rotary shaft, in particular a first end of the beater is fixedly mounted to the shaft, and extends from the shaft in a plane substantially transverse to said shaft. The beater is configured to rotate upon rotation of said rotary shaft, in particular in said plane which is substantially transverse to said shaft. Upon rotation of the shaft, the beater is configured to strike the drum. The drum pedal also comprises an actuation mechanism for rotating the beater in a first direction towards the drum. The actuation mechanism can for example comprise a foot plate, which is linked via a flexible member, such as for example a chain or band, to the rotary shaft, such that a pressure or pushing movement on the foot plate is transformed into a rotation of the rotary shaft in a first direction, such that the beater moves towards a drum so that the beater can strike the drum. The actuation mechanism may for example be configured such that in rest, the foot plate is in a tilted position, in which a first end in a longitudinal direction of the foot plate is placed higher than a second end in said longitudinal position. Said first end can then be linked to the rotary shaft, and the difference in height between the first and the second end of the foot plate due to the tilted position of the foot plate can allow a downward movement of the first end of the footplate provoking a rotation of the rotary shaft in a first direction. The actuation mechanism can generally be placed substantially centrally on the drum pedal, for example between the two legs in case of a two-leg support, or above a bottom part of a substantially L-shaped one-leg support. The drum pedal also comprises a return mechanism for rotating the beater in a second direction opposite the first direction in order to move the beater away from the drum. Said return mechanism may include a pre-tensioned element, such as a spring or any other suitable element, such that actuation of the beater in the first direction is performed against a force exerted by the pre-tensioned element. As such, the return mechanism causes the rotary shaft to rotate back to an initial position substantially at rest as soon as pressure on the actuation mechanism has been released. In an inventive way, the drum pedal further comprises at least one bearing assembly, wherein the at least one leg of the support is located between the actuation mechanism and the at least one bearing assembly. Including a bearing assembly into the drum pedal can improve smooth rotation of the rotary shaft leading to more precise control on the striking of the drum. Contrary to prior art drum pedals, in which a bearing may be included in the actuation mechanism or in the support, the at least one bearing assembly is now mounted on the drum pedal in such a way that the bearing assembly is spaced-apart from the actuation mechanism with the at least one leg being located in between the bearing assembly and the actuation mechanism. In other words, when the actuation mechanism is placed relatively centrally in the drum pedal, and engages the rotary shaft more or less in a middle of the shaft, the at least one bearing assembly is mounted eccentrically on the rotary shaft, preferably towards an end portion of said rotary shaft. This positioning of the at least one bearing assembly has appeared to show a double advantage: the actuation mechanism can be more light-weight as it does not need to include a bearing. A relatively light-weight actuation mechanism can imply that less effort is needed to actuate the beater. At the same time, separation of the bearing assembly and the actuation mechanism can provide an improved balance of the rotary shaft, which can help in improving precision in use of the drum pedal.

The at least one bearing assembly can preferably include a bearing, a bearing support configured to support the bearing, and a bearing chamber configured to receive the bearing. The bearing support may be configured to be fixedly mounted at least partly within an upper end portion of the at least one leg of the support. The bearing support may be configured such that the rotary shaft can extend through the bearing support and can rotate freely within said non-rotating bearing support. The bearing configured to be mounted on the bearing support can for example be a roller bearing or more preferably a ball bearing. A bearing chamber can finally be configured to be mounted over the bearing, in an engaging contact with the bearing. In this way, a bearing assembly is obtained with a minimum of pieces in order to simplify the design of the drum pedal.

The bearing chamber may advantageously be connected to the rotary shaft such that the bearing chamber is configured to transfer rotation of the rotary shaft to rotation of the bearing. In particular, there may be a direct connection between the rotary shaft and the bearing chamber, by fixedly connecting the bearing chamber to the rotary shaft. As such, rotation of the rotary shaft implies rotation of the bearing chamber, which causes a radially outer side of the bearing to rotate. In this way, the rotary shaft can be centered relatively precisely during rotation, which can improve precision of movement of the beater. This is contrary to drum pedals of the prior art including one or more bearings. In prior art drum pedals, having for example a bearing in the actuation mechanism or in the legs of the support, a rotary shaft can rotate within a radially interior side of the bearing, in which case the bearing only helps in improving a smooth rotation of the shaft. In a drum pedal according to the present invention, the rotary shaft does not rotate directly within the bearing, but only transfers rotation via the bearing chamber to an outer side of the bearing, in which case the bearing helps in centring the rotary shaft. As the centring of the shaft can be done at least partly by the bearing assembly, the drum pedal according to the invention can allow a relatively large clearance between the rotary shaft and the bearing support in which the shaft is received. Larger clearance can mean less resistance and less wear. In this way, the improved stability due to the spacing apart of support points of the rotary shaft, and precision in centring of the rotary shaft can provide a relatively precise beat and can allow a relatively smooth and rapid playing. The bearing chamber is thus rotatably fixed to the outer ring of the bearing, and the bearing chamber is rotatably fixed to the rotary shaft such that a rotation of the rotary shaft induces a rotation of the bearing chamber and the outer ring of the bearing.

Different arrangements are possible. The bearing support and the at least one leg can be made in one piece, the bearing support (29) can be made of one piece, or the bearing support (19) can be made of two pieces.

An external part (19*b*, 29*b*) of the bearing support (19, 29) can be configured to be installed in the upper part of the leg (3) or forms a single piece with the leg (3), and an inner part (19*a*, 29*a*) can be configured to bear a bearing whose inner diameter substantially corresponds to the outer diameter (D2) of the inner part (19*a*, 29*a*). It is an advantage that thanks to the inner part of the bearing support, the bearing is not in the same vertical plane perpendicular to the shaft as the leg. Furthermore, the inner part of the bearing support allows to change the dimensions of the bearing to any dimensions and any types, each dimensions and types providing a different effect to the player. It is only required that the inner diameter of the bearing support is larger than the diameter of the shaft, to allow a free rotation of the shaft inside the bearing support.

The bearing chamber can preferably include a bearing receiving portion and a rotary shaft receiving portion. In particular, the bearing chamber may have a bearing receiving portion with a relatively large inner diameter configured to fit over the bearing in an engaging contact with the bearing, and a rotary shaft receiving portion with a relatively small inner diameter, which may include a female tenon or mortise, such that the rotary shaft can be received relatively tightly in said shaft receiving portion. Additionally, fixation means may improve fixation or clamping of the bearing chamber on the rotary shaft.

It is preferred that the return mechanism engages the at least one bearing assembly. In this way, the bearing can compensate for a moment of inertia at the moment of a strike of the drum by the beater, or the moment pressure on the actuation mechanism is released. This can allow an improved and a relatively quick response time and relatively precise return movement of the beater, and can allow a relatively rapid beat to be played.

More preferably, the at least one leg of the support can be located between the actuation mechanism and the return mechanism. In this way, the return mechanism is spaced apart from the actuation mechanism, which leaves more space for a foot of a user actuating the drum pedal via a foot plate of the actuation mechanism. In drum pedals of the prior art, in which the return mechanism is not separated from the actuation mechanism by a leg from the support, the return mechanism may be placed closely to the actuation mechanism, which may hinder the user of the drum pedal, especially in his foot movement to actuate the actuation mechanism, for example via a foot plate.

The support can advantageously have two legs, located on either lateral side of the actuation mechanism. In other words, the actuation mechanism, or at least part of the mechanism, is located in between the two legs of the support. Such a support can provide a more solid and stable support than a support having a single leg. In this case, the rotary shaft can be borne by both legs of the support, in particular by an upper end of each of the legs, such that the rotary shaft can extend from one leg to the other leg of the support, or even extend through one or both of the upper ends of the legs of the support, providing stability to the rotary shaft.

The drum pedal may then preferably comprise two bearing assemblies, the two legs of the support being located in between the two bearing assemblies. A bearing assembly on either side of the rotary shaft can provide a relatively large stability to rotation of the shaft, due to the spacing apart of the bearing assemblies and due to the presence of an extra bearing, and thus improve precision and rapidity of the beat.

At least one of the bearing assemblies may then preferably include a bearing chamber having a bearing receiving portion and a rotary shaft receiving portion, as previously described. Both bearing assemblies may comprise a bearing, a bearing support configured to support the bearing, and a bearing chamber configured to receive the bearing. The bearing support may be configured to be fixedly mounted at least partly within an upper end portion of the at least one leg of the support. The bearing support may be configured such that the rotary shaft can extend through the bearing support and can rotate freely within said non-rotating bearing support. The bearing configured to be mounted on the bearing support can for example be a roller bearing or more preferably a ball bearing. A bearing chamber can finally be configured to be mounted over the bearing, in an engaging contact with the bearing. One of the bearing chambers, and preferably both of the bearing chambers, may include a rotary shaft receiving portion, such that the rotary shaft can be received relatively tightly in said shaft receiving portion. An exterior shape of the two bearing chambers may preferably differ, in that one of the bearing chambers may include a pin portion having a reduced exterior diameter, to which pin portion the return mechanism may be connected. The pin portion with a reduced exterior diameter may correspond to the shaft receiving portion internally. The other bearing chamber may have the same shape, or may have a substantially cylindrical shape having a single exterior diameter in spite of two different internal diameters, in which case the shaft receiving portion may, but need not, be made shorter than the shaft receiving portion inside a pin portion having a reduced external diameter. As no connection with a return mechanism is needed on said second bearing chamber, there is no need for a bearing chamber having two different external diameters. In this way, one of the bearing chambers may be a smaller piece than the other bearing chamber, which can save weight, material and manufacturing costs.

The bearing chamber and the outer ring of the bearing are rotatably fixed. For example, the diameter of the bearing chamber can substantially correspond to the external diameter of the outer ring. The friction due to the close contact between both surfaces of the bearing chamber and the outer ring ensures them rotating together.

As the bearing chamber is rotatably fixed to the shaft, the outer ring of the bearing is also rotatably fixed to the shaft, via the bearing chamber. The shaft therefore guides the outer ring of the bearing, while the inner ring does not rotate.

According to a second aspect of the invention, there is provided a retrofitting assembly having the featured of claims 11-16 for transforming a drum pedal into a drum pedal as described above. Such a retrofitting assembly can provide one or more of the above-mentioned advantages.

The bearing can have a larger diameter than the bearing it is configured to replace in the drum pedal to be transformed. It is an advantage that changing the diameter of the bearing provides a different dynamical behavior of the pedal to the user.

It is an advantage that the bearing support (19, 29) comprises two parts (19*a*, 19*b*, 29*a*, 29*b*), an exterior part (19*b*, 29*b*) which has the same dimensions as the bearing of the pedal it is configured to replace and an interior part which is configured to bear a new bearing, and whose external diameter (D2) corresponds to the inner diameter of the inner ring of the new bearing (18). It is easy to change the diameter of the bearing. It is also possible to provide a retrofitting assembly with different types and/or dimensions of bearings. The bearing support and the chamber have then dimensions which correspond to the dimensions of the bearing.

The inner diameter (D5) of the bearing support (19, 29) is preferably larger than the diameter of the shaft to allow a free rotation of the shaft inside the bearing support.

The assembly can be provided on at least one of, the leg which is on the same side as the return mechanism, the leg which is on the opposite side of the return mechanism, or on both legs. Again, different configurations are possible, each configuration providing a different effect to the player using the pedal.

According to a third aspect of the invention, there is provided a method of retrofitting a drum pedal, the method having the features of claim 11. Such a method can provide one or more of the above-mentioned advantages. Additionally, by providing a retrofitting assembly and a method of retrofitting a drum pedal, the invention can provide an improved drum pedal allowing relatively rapid and precise striking of a drum at a relatively modest cost for the user, since only a limited number of pieces of the drum pedal need to be replaced, which can be done in a relatively straight forward manner.

The present invention will be further elucidated with reference to figures of exemplary embodiments. Corresponding elements are designated with corresponding reference signs.

FIG. 1 shows a perspective view on a preferred embodiment of a drum pedal;

FIGS. 2*a* and 2*b* show an axonometric and a partly exploded view, respectively, of a preferred embodiment of a retrofitting assembly for a drum pedal.

FIGS. 3*a*, 3*b* and 3*c* illustrate the dimensions of a support bearing element provided as a single piece.

Figure 4:
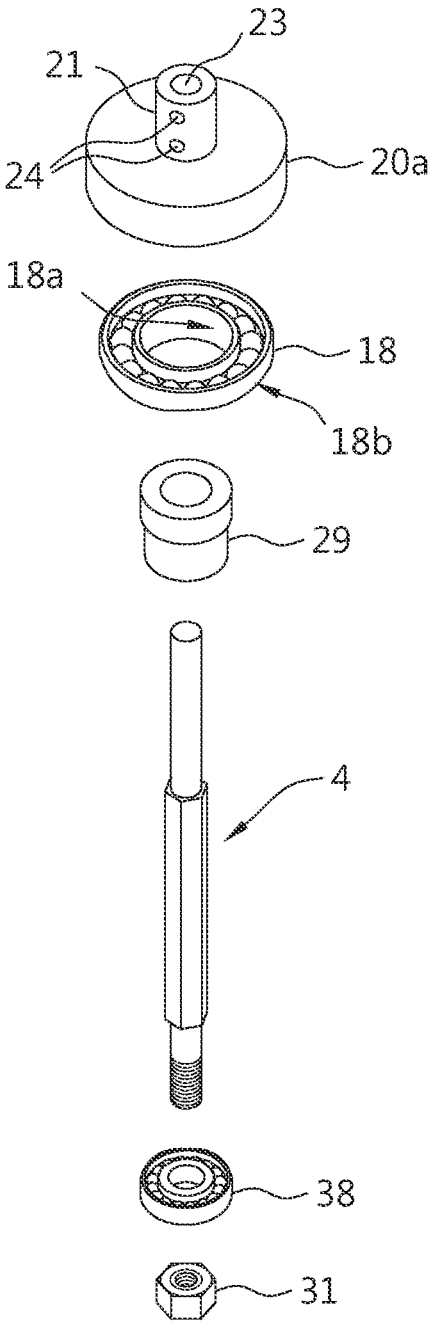
Figure 5:
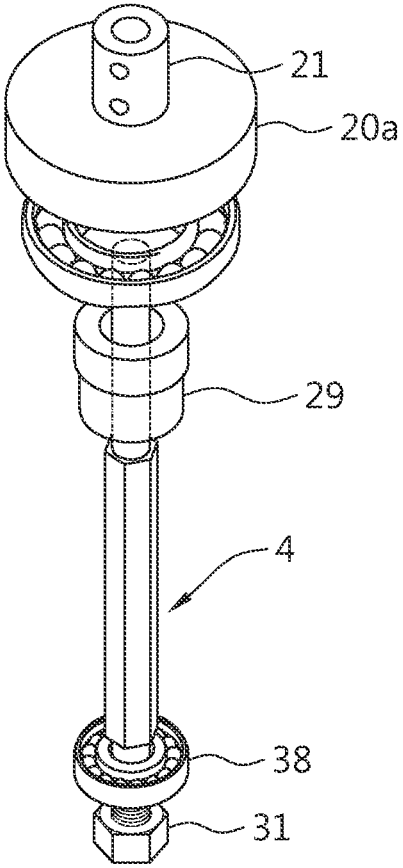

FIGS. 4 and 5 show an axonometric and a partly exploded view, respectively, of another embodiment of a retrofitting assembly for a drum pedal.

FIG. 1 shows a perspective view on a preferred embodiment of a drum pedal 1 according to the invention. The drum pedal 1 for striking a drum (not shown) comprises a support 2 having two legs 3 providing a substantially U-shaped support, a rotary shaft 4 borne by said support 2, in particular by upper ends 3*a* of the legs 3, a beater 5 mounted on said rotary shaft 4 in a way known to the person skilled in the art and configured to rotate upon rotation of said rotary shaft 4, the beater 5 being configured to strike the drum.

The drum pedal 1 further comprises an actuation mechanism 6 for rotating the beater 5 in a first direction 7 towards the drum, and a return mechanism 13 for rotating the beater 5 in a second direction 8 opposite the first direction 7 away from the drum. The actuation mechanism 6 of the present embodiment for example comprises a foot plate 9, which is linked via a flexible member 10, in particular a chain, to the rotary shaft 4, such that a pressure or pushing movement on the foot plate 9 is transformed into a rotation of the rotary shaft 4 in a first direction 7, such that the beater 5 moves towards a drum so that the beater 5, in particular a cushioned end portion 11 of the beater 5, can strike the drum.

The flexible member 10 is linked to the rotary shaft 4 via a transmission element 12 which is configured to locally enlarge a diameter of the rotary shaft 4 in order to increase a lever arm of the force acting via the flexible member 10 on the rotary shaft 4. Thanks to the present invention, this transmission element 12 can be made relatively lightweight, for example in plastic or aluminum, contrary to prior art drum pedals, in which this transmission piece 12 is rather bulky and relatively heavy, even often made of metal. The actuation mechanism 6 may for example be configured such that in rest, the foot plate 9 is in a tilted position, in which a first end 9*a* in a longitudinal direction of the foot plate 9 is placed higher than a second end 9*b* in said longitudinal direction. Said first end 9*a* can then be linked to the rotary shaft 4, and the difference in height between the first and the second end of the foot plate 9 due to the tilted position of the foot plate 9 can allow a downward movement of the first end 9*a* of the footplate 9 provoking a rotation of the rotary shaft 4 in a first direction 7.

The actuation mechanism 6 can generally be placed substantially centrally on the drum pedal 1, for example between the two legs 3 of the substantially U-shaped support. Also the transmission element 12, to which the flexible element 10 is fixedly attached, is preferably placed substantially centrally on the rotary shaft 4. The drum pedal 1 further comprises at least one bearing assembly, in the present preferred embodiment two bearing assemblies 16, 17.

The two legs 3 of the support 2 are preferably located in between the two bearing assemblies 16, 17, and each of the legs 3 of the support 2 is located between the actuation mechanism 6 and the respective bearing assembly 16, 17. The bearing assemblies 16, 17 each include a bearing 18, a bearing support 19 and a bearing chamber 20*a*, 20*b*.

The bearing support 19 is partly received within the upper end 3*a* of the leg 3 of the support 2 and can be fixated with respect to said leg 3, for example via a screw or other fixation means, so that the bearing support cannot rotate within the upper end portion 3*a* of the leg 3. It is also possible to provide a pedal having a leg in which the bearing support and the leg are made in one piece.

The bearing 18 is fixedly mounted on said bearing support 19, in particular on the part extending from the upper end portion 3*a* of the leg 3.

The bearing chamber 20*a*, 20*b* is mounted over the bearing 18 such that a bearing receiving portion of the bearing chamber can engage the bearing 18 and a shaft receiving portion can receive the rotary shaft 4. The rotary shaft 4 can then be fixated to the bearing chamber 20*a*, 20*b* via one or more screws or other fixation means.

The return mechanism 13 for rotating the beater 5 in the second direction 8 opposite the first direction 7 away from the drum can include a spring 14, or any other suitable pre-tensioned element, of which one end is fixedly attached to the support 2, and of which an opposite end is connected to the rotary shaft 4, for example via a clamping element 15. In the present preferred embodiment of the drum pedal 1, the clamping element 15 can engage the bearing chamber 20*a* of the bearing assembly 16, which chamber can include a pin portion 21 with a reduced external diameter allowing the clamping element 15 to engage the bearing chamber 20*a*. As a result, pressure on the foot plate 9 is transferred via the flexible element 10 and the transmission element 12 to the rotary shaft 4 and results in the rotary shaft 4 rotating in the first direction 7, moving the beater 5 towards a drum. Rotation of the rotary shaft 4 also results in rotation of the bearing chambers 20*a*, 20*b*, which rotate on a radially exterior side of the bearing 18 (i.e. on the outer ring of the bearing 18).

This is contrary to the functioning of prior art drum pedals, sometimes presenting one or more bearings, for example centrally in the actuation mechanism or in the legs of the support, in which a rotary shaft rotates within a radially interior side of the bearing (or a rotation of the rotary shaft drives the inner ring of the bearing). In prior art pedals, the spring element is fixed by a clamping element fixed for example directly to the shaft.

The drum pedal as embodied in FIG. 1 can allow a relatively large clearance between the rotary shaft 4 and the bearing support 19 in which the shaft is received. The diameter of the rotary shaft 4 is thus preferably smaller than the inner diameter of the bearing support. Larger clearance can mean less resistance and less wear. The relatively large clearance can be compensated for by the relatively precise centring of the shaft due to both the spacing apart of the actuation mechanism and the bearing assemblies and to the centring effect of the bearing 18 mounted on the fixated bearing support 19 with the bearing chambers 20*a*, 20*b* being connected to the rotary shaft 4.

In this way, the improved stability and precision of the rotary shaft can provide a relatively precise beat and allows a relatively rapid playing. At the same time, actuation of the drum pedal 1 is done against a pre-tensioning force of the return mechanism 13, in particular of the spring 14.

As the connection of the return mechanism 13 with the rotary shaft 4 is done here via the clamping element 15 which engages one of the bearing chambers, in particular the bearing chamber 20*a* having a pin portion 21 with a reduced external diameter, and as this bearing chamber 20*a* rotates on a bearing 18, the drum pedal 1 can compensate for an effect of inertia at the moment of inversion of the direction of rotation of the shaft 4, which is present in drum pedals of the prior art. This again can allow an improvement in the speed of playing while keeping power and precision.

In fact, as the rotary shaft is configured to drive the outer ring of the bearing via the chamber, the moment is increased as the distance between the center of the rotary shaft and the ring is increased.

FIGS. 2*a* and 2*b* show an axonometric and a partly exploded view, respectively, of a preferred embodiment of a retrofitting assembly for a drum pedal 1 according to the invention.

This retrofitting assembly is in particular suitable for a drum pedal having a support with two legs 3, as shown for example in FIG. 1, but could also be used on a support having only a single leg.

It is also preferred that the drum pedal to be retrofitted includes a return mechanism configured to be attached to an outer end of the rotary shaft rather than to a central portion of the rotary shaft, as may sometimes be the case in prior art drum pedals.

All parts of the present embodiment of the retrofitting assembly are also part of the embodiment of the drum pedal 1 as shown in FIG. 1, therefore, the same reference signs are used for indicating corresponding parts.

The rotary shaft 4 may for example have a substantially hexagonal cross-section in a middle portion 4*a* of the shaft, while end portions 4*b* of the shaft 4 may have a substantially circular cross-section. In this way, a beater 5 can be fixedly mounted on the rotary shaft 4 in a relatively stable manner, the shape of the cross-section substantially preventing slipping of the fixation of the beater 5 on the rotary shaft 4. The same is valid for the actuation mechanism 6, in particular for a transmission element 12 of the actuation mechanism 6, having a better grip on the rotary shaft 4 than if the cross-section of the shaft were substantially circular. Instead of a hexagonal shape, other substantially polygonal shapes for a middle portion of the rotary shaft may be possible.

The substantially circular cross-sections of end portions 4*b* of the rotary shaft, to the contrary, can improve smooth rotation of the rotary shaft 4.

The rotary shaft 4 preferably has a length such that end portions 4*b* of the rotary shaft 4 can extend through one or two end portions 3*a* of the at least one leg 3 of a support 2 of the drum pedal 1, for example a length in a range of more or less 150 mm to more or less 220 mm, for example a length of substantially 190 mm, which range can cover more or less a range of widths of presently commercialized supports. Such a length may be longer than a length of the rotary shaft to be replaced, as the rotary shaft of a prior art drum pedal does usually not extend further beyond the support of the drum pedal.

A diameter of such a rotary shaft at a portion with a substantially circular diameter is generally around more or less 8 mm or smaller, for example in a range of more or less 5 mm to more or less 8 mm, so that a rotary shaft can be replaced by another rotary shaft, such as the rotary shaft 4 of the present retrofitting assembly, relatively easily.

The retrofitting assembly of the present embodiment further comprises one or two bearing assemblies 16, 17. The at least one bearing assembly 16, 17 includes a bearing 18, a bearing support 19 configured to support the bearing 18, and a bearing chamber 20 configured to receive the bearing 18. In this embodiment, the bearing support 19 may be made of two pieces, an interior part 19*a* and an exterior part 19*b*, in which the interior part 19*a* is at least partly received. Alternatively, the bearing support 19 might be made in a single piece.

In case of two pieces, or in case of a single piece having an exterior and an interior part, the interior part 19*a* is configured to receive the rotary shaft in such a way that the rotary shaft can rotate within the interior part 19*a*. Thus, the inner diameter of the interior part is advantageously larger than the diameter of the rotary shaft to avoid any friction.

The exterior part 19*b* is configured to be at least partly, preferably substantially entirely, received within an upper end portion 3*a* of the at least one leg 3 of the support 2 of the drum pedal 1.

The exterior part 19*b* can for example be made of a synthetic material, as this part may need more elasticity to fit into the upper portion 3*a* of a leg 3, whereas the interior part 19*a* may for example be made of metal, which may be more solid than a synthetic material.

The exterior part 19*b*, in which the interior part 19*a* can at least partly be received, is configured to be fixedly mounted in said upper end portion 3*a*. The interior part 19*a* partly extends from the exterior part 19*b*, and this extending portion is configured to bear the bearing 18.

The bearing 18 is preferably a ball bearing, but could also be another type of suitable bearing. The at least one bearing assembly 16, 17 also include a bearing chamber 20.

In this embodiment of the retrofitting assembly, the two bearing chambers 20*a*, 20*b* differ in exterior shape: a first bearing chamber 20*a* having a pin portion 21 with a smaller exterior diameter than an exterior diameter of the portion receiving the bearing 18, and a second bearing chamber without said pin portion. Both the first and the second bearing chambers 20*a*, 20*b* have a bearing receiving portion and a rotary shaft receiving portion, the rotary shaft being received in the female tenon 23.

The rotary shaft 4 can then be fixedly connected to the bearing chamber 20*a*, 20*b*, for example by one or more fixation means 24, such as screws extending radially through the bearing chamber 20*a*, 20*b*, implying a need for longer fixation means for the bearing chamber 20*b* without pin portion than for the bearing chamber 20*a* with a pin portion 21. Other fixation means, preventing the rotary shaft 4 from rotating within the bearing chamber 20*a*, 20*b*, and allowing the bearing chamber 20*a*, 20*b* to rotate with the rotary shaft 4, can also be used.

The retrofitting assembly may also comprise a clamping element 15 configured to connect a return mechanism of a drum pedal to the at least one bearing assembly 16, 17, in particular to the bearing chamber 20*a* having a pin portion 21. In this way, the clamping element can be adapted in size to an external diameter of the pin portion 21 of the bearing chamber 20*a* of the bearing assembly 16 of the retrofitting assembly.

Figure 3:
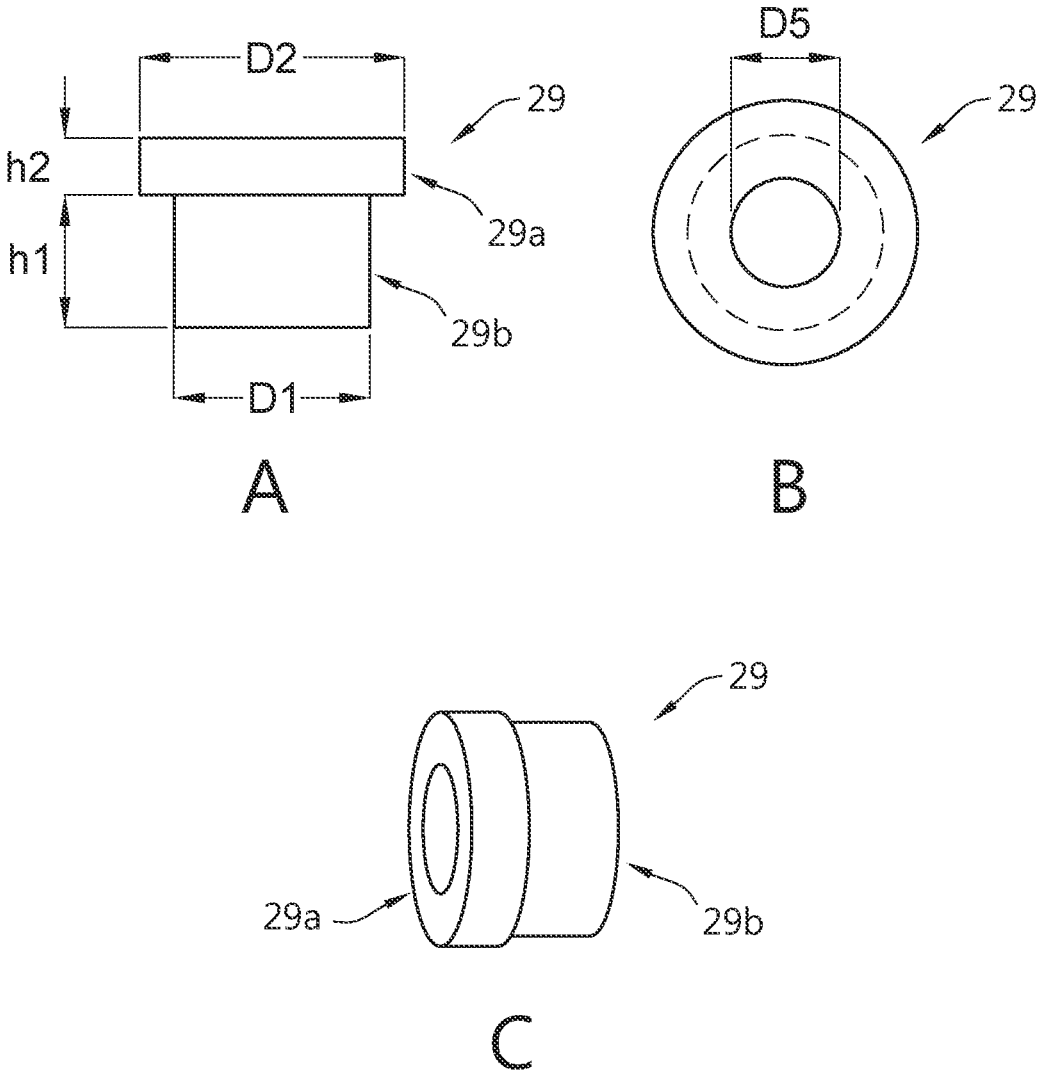

As described above, the bearing support can also be made in a single piece. FIG. 3 illustrates such a bearing support, made in a single piece. As in the first embodiment, the exterior part 29*b* is configured to replace the ball bearing installed in the upper end portion of a leg of a state of the art pedal, and thus preferably has the same dimensions as the ball bearing it is configured to replace. Therefore, the diameter D1 of the exterior part 19*b*, 29*b* is substantially identical to the external diameter of the ball bearing it replaces. State of the art pedals comprise ball bearings with an external diameter of for example 22 mm.

The interior part 19*a*, 29*a* is configured to bear the bearing 18. Therefore, the diameter D2 of the interior part 19*a*, 29*a* substantially corresponds to the inner diameter of the bearing 18, or to the diameter of the inner ring 18*a*.

It is an advantage that the bearing 18 is provided outside of the leg 13, or in other words, the bearing 18 is not in the prolongation of the leg, but is provided in a vertical plane, perpendicular to the shaft, different from the plane perpendicular to the leg and intersecting the leg.

Advantageously, thanks to the bearing support element 19, 29, the diameter of the inner ring of the bearing 18 can have any size which is larger than the diameter of the rotation shaft 4. Advantageously, a substantially larger bearing can be provided, which has the advantage of increasing the moment of inertia of the shaft, which thereby has an effect on the way the foot drives the pedal. Thus, different sizes can easily be provided to existing pedals, each type of bearing providing a different effect. The musician can thus easily adapt the characteristics of the pedal for different situations, or types of music, etc. simply by providing a different bearing to his drum pedal.

For each type of bearing, a different bearing support element 19, 29 having the same outer diameter D2 than the inner diameter of the inner ring 18*a* of the bearing 18 and a different chamber 20*a*, having a diameter which substantially corresponds to the outer diameter of the outer ring 18*b* of the bearing, should be provided.

Therefore, the diameter D2 of the bearing support element 29 determines the diameter of the new bearing 18. The internal diameter of ball bearing 18 can be for example 25 mm and the outer diameter for example 37 mm. The invention allows to use any type and size of bearing 18 on the interior part 29*a* of the bearing support 29, which acts as an interface between the previous bearing and the new bearing 18.

Furthermore, the bearing support 29 is configured to be mounted around the shaft 4. However, the shaft 4 should rotate freely inside the bearing support 29. Therefore, the internal diameter D5 of the bearing support 29 should be larger than the diameter of the shaft 4 such that it does not enter in contact with the bearing support when mounted on the pedal. FIG. 5 illustrates this difference in diameter between the bearing support and the shaft 4.

As illustrated in FIG. 4, the bearing 18 is configured to be mounted on the interior part 29*a* of the bearing support 29 via its inner ring 18*a*.

As described with reference to FIG. 2*a*, the bearing chamber 20*a* is configured to be mounted over the bearing 18 such that a bearing receiving portion of the bearing chamber can engage the bearing 18 and a shaft receiving portion can receive the rotary shaft 4. The rotary shaft 4 can then be fixated to the bearing chamber 20*a* such that they drive one another when rotating. This way, a rotation of the rotary shaft induces a rotation of the chamber, which induces a rotation of the outer ring 18*b* of bearing 18. Therefore, when the rotary shaft 4 rotates, the inner ring 18*a* of the bearing 18 does not rotate.

For the bearing chamber 20*a* to rotate when the rotary shaft 4 rotates, the bearing chamber shall be rotatably fixed to the rotary shaft. Different fixations means are possible, as illustrated in reference to FIG. 2*a*, wherein the chamber comprises a portion with a reduced internal diameter 23 which substantially corresponds to the diameter of the rotary shaft, or wherein the chamber comprises a pin portion 21, fixedly attached to the chamber. The female tenon portion 23 is configured to receive the shaft and/or to be rotatably fixed to the shaft such that a rotation of the rotary shaft induces a rotation of the chamber.

The rotary shaft 4 could also have a non-circular section, for example polygonal section in at least the portion configured to be rotatably fixed to the chamber, in a similar manner as the portion 4*a* of the shaft which is configured to induce a rotation of the intermediate element 12.

The shaft could also have a non-circular section as described above over its entire length. It is important to ensure that the rotary shaft can rotate freely within the bearing support 19, 29 element as described above.

In order to ensure that the pedal returns to its rest position, the return mechanism 13 is preferably fixed to the chamber 20*a*. For example, as described in reference to FIG. 2*a*, the return mechanism can be fixed for example to the pin portion 21, for example by means of a clamping element 15, as illustrated in FIG. 1 and as explained above.

In the example shown on FIGS. 4 and 5, bearing 38 corresponds to a bearing of the state of art pedals, i.e. to the default bearing mounted in the upper part of the leg 3. It is sufficient to change only one of the two bearings to see an improvement or change in the operation of the pedal. The inner ring of the bearing 38 rotates upon rotation of the rotary shaft 4, as in prior art pedals. A nut 31 is provided to fix the end of the rotary shaft 4 via threads provided at the end of the shaft to the frame of the drum pedal 1.

It is thus possible to change only one of the two bearings 28, 38. While we have shown that it is possible to change the bearing which is located on the same side as the return mechanism 13 (usually right side of the pedal), it is also possible to change the bearing which is located on the other side, i.e. the side opposite to the return mechanism, and thereby keep intact the original return mechanism 13 of the pedal. It is to be noted that each configuration provides a different type of sound and effect to the user.

For the purpose of clarity and a concise description, features are described herein as part of the same or separate embodiments, however, it will be appreciated that the scope of the invention may include embodiments having combinations of all or some of the features described. It may be understood that the embodiments shown have the same or similar components, apart from where they are described as being different.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage. Many variants will be apparent to the person skilled in the art. All variants are understood to be comprised within the scope of the invention defined in the following claims.

The invention claimed is:

1. A drum pedal for striking a drum, the pedal comprising:

a support having at least one leg;

a rotary shaft borne by said support;

a beater mounted on said rotary shaft and configured to rotate upon rotation of said rotary shaft, wherein the beater is configured to strike the drum;

an actuation mechanism for rotating the beater in a first direction towards the drum;

a return mechanism for rotating the beater in a second direction opposite the first direction away from the drum;

wherein the drum pedal further comprises at least one bearing assembly, wherein the at least one leg of the support is located between the actuation mechanism and the at least one bearing assembly, wherein the at least one bearing assembly includes a bearing, a bearing support configured to support the bearing, and a bearing chamber configured to receive the bearing, wherein the bearing chamber is connected to the rotary shaft such that the bearing chamber is configured to transfer rotation of the rotary shaft into rotation of the bearing, and wherein an external part of the bearing support is configured to be installed in the upper part of the leg or forms a single piece with the leg, and an inner part is configured to bear a bearing whose inner diameter substantially corresponds to the outer diameter of the inner part.

2. The drum pedal according to claim 1, wherein the bearing support and the at least one leg form one piece, wherein the bearing support is made of one piece, or wherein the bearing support is made of two pieces.

3. The drum pedal according to claim 1, wherein the bearing chamber includes a bearing receiving portion and a rotary shaft receiving portion.

4. The drum pedal according to claim 1, wherein the return mechanism engages the at least one bearing assembly.

5. The drum pedal according to claim 2, wherein the at least one leg of the support is located between the actuation mechanism and the return mechanism.

6. The drum pedal according to claim 1, wherein the support has two legs, located on either lateral side of the actuation mechanism.

7. The drum pedal according to claim 6, comprising two bearing assemblies, wherein the two legs of the support are located in between the two bearing assemblies.

8. The drum pedal according to claim 6, wherein at least one of the bearing assemblies includes a bearing chamber having a bearing receiving portion and a rotary shaft receiving portion.

9. The drum pedal according to claim 6, wherein the bearing chamber is rotatably fixed to the outer ring of the bearing, for example the diameter of the bearing chamber substantially corresponds to the external diameter of the outer ring of the bearing.

10. A retrofitting assembly for transforming a drum pedal into a drum pedal for striking a drum, the assembly comprising:

a rotary shaft;

at least one bearing assembly including a bearing, a bearing support configured to support the bearing, and a bearing chamber configured to receive the bearing, wherein the bearing chamber of the bearing assembly is configured to engage the rotary shaft at an outer end of the rotary shaft such that an at least one leg of a support of a drum pedal is located between the at least one bearing assembly and an actuation mechanism of the drum pedal, and wherein the bearing support comprises two parts, an exterior part which has the same dimensions as the bearing of the pedal it is configured to replace and an interior part which is configured to bear a new bearing, and whose external diameter corresponds to the inner diameter of the inner ring of the new bearing.

11. The retrofitting assembly according to claim 10, wherein the bearing has a larger diameter than the bearing it is configured to replace in the drum pedal to be transformed.

12. The retrofitting assembly according to claim 10, wherein the inner diameter of the bearing support is larger than the diameter of the shaft.

13. The retrofitting assembly according to claim 10, wherein the assembly is provided on at least one of, the leg which is on the side of the return mechanism, the leg which is on the opposite side of the return mechanism, or on both legs.

14. The retrofitting assembly according to claim 10, further comprising a connecting piece configured to engage the bearing chamber of the bearing assembly and configured to connect a return mechanism of the drum pedal to the rotary shaft.

15. A method of retrofitting a drum pedal comprising the steps of:

providing a drum pedal;

providing a retrofitting assembly for transforming the drum pedal into a drum pedal for striking a drum, the assembly comprising a rotary shaft at least one bearing assembly including a bearing, a bearing support configured to support the bearing, and a bearing chamber configured to receive the bearing, wherein the bearing chamber of the bearing assembly is configured to engage the rotary shaft at an outer end of the rotary shaft such that an at least one leg of a support of a drum pedal is located between the at least one bearing assembly and an actuation mechanism of the drum pedal, and wherein the bearing support comprises two parts, an exterior part which has the same dimensions as the bearing of the pedal it is configured to replace and an interior part which is configured to bear a new bearing, and whose external diameter corresponds to the inner diameter of the inner ring of the new bearing;

replacing a rotary shaft of the drum pedal by the rotary shaft of the retrofitting assembly;

mounting the at least one bearing assembly to an outer end of the rotary shaft such that an at least one leg of a support of the drum pedal is located between the at least one bearing assembly and an actuation mechanism of the drum pedal.

* * * * *